US005315816A

United States Patent [19]

Kemmer et al.

[11] Patent Number: 5,315,816

[45] Date of Patent: May 31, 1994

[54] METHOD AND DEVICE FOR TEMPERATURE CONTROL IN A COMBUSTION PLANT

[75] Inventors: Leif Kemmer, Lotorp, Sweden; Dilip Mukherjee, Fislisbach, Switzerland; Göran Tjellander, Finspong, Sweden

[73] Assignee: ABB Stal AB, Sweden

[21] Appl. No.: 946,479

[22] PCT Filed: May 8, 1991

[86] PCT No.: PCT/SE91/00337

§ 371 Date: Jan. 8, 1993

§ 102(e) Date: Jan. 8, 1993

[87] PCT Pub. No.: WO91/17389

PCT Pub. Date: Nov. 14, 1991

[30] Foreign Application Priority Data

May 10, 1990 [SE] Sweden ..... 9001688

[51] Int. Cl.[5] ..... F02C 3/26

[52] U.S. Cl. ..... 60/39.02; 60/39.464; 60/728

[58] Field of Search ..... 60/39.02, 39.182, 39.464, 60/39.511, 728

[56] References Cited

U.S. PATENT DOCUMENTS 3,422,800 1/1969 LaHaye ..... 60/391.82
4,852,345 8/1989 Greis ..... 60/39.464
4,852,346 8/1989 Granqvist et al. ..... 60/39.464
4,951,460 8/1990 Prochaska et al. ..... 60/39.511
5,010,726 4/1991 Garland ..... 60/39.511

FOREIGN PATENT DOCUMENTS 79602 of 0000 Denmark .
191082 of 0000 Sweden .
205317 of 0000 Sweden .

*Primary Examiner*—Louis J. Casaregola
*Attorney, Agent, or Firm*—Pollock, Vande Sande & Priddy

[57] ABSTRACT

A method for cooling and eliminating temperature variations in a power plant for combustion of a fuel in a pressurized fluidized bed includes pressuring air in a compressor and supplying the pressurized air to the pressurized fluidized bed through air paths after the pressurized air is cooled and temperature variations in the pressurized air are substantially eliminated prior to supplying the pressurized air into the pressurized fluidized bed in at least one transfer surface provided in the air paths. The at least one heat transfer surface is connected with a high temperature section of a feedwater/steam section for utilizing energy extracted in the heat transfer surface and the temperature variations of the pressurized air supplied to the pressurized fluidized bed are eliminated by controlling the feedwater/steam flow through the heat transfer surface based on the deviations between a desired temperature of the air to be delivered to the fluidized bed and a measured temperature of the pressurized air from the compressor.

14 Claims, 4 Drawing Sheets

METHOD AND DEVICE FOR TEMPERATURE CONTROL IN A COMBUSTION PLANT

TECHNICAL FIELD

The present invention relates to limitation of temperature variations in flowing gases in a combustion plant in which heat transfer surfaces are arranged in the gas paths to limit the temperature of the gas which is supplied to a combustor located in the plant and of the flue gases emitted from the plant. The invention is especially valuable in a power plant with combustion in a pressurized fluidized bed, a Pressurized Fluidized Bed Combustion (PFBC)—plant, in which it permits limitation of temperature variations in pressurized air supplied to the combustor and flue gases emitted from the plant. This means that power output or efficiency remains essentially unaffected by variations in ambient temperature and compression ratios.

BACKGROUND OF THE INVENTION

During combustion in a fluidized bed, the fluidized bed is supplied with air for fluidization of the bed material and for combustion of fuel supplied to the fluidized bed. If the fluidized bed is part of a plant for combustion in a pressurized fluidized bed, a PFBC plant, the fluidized bed contained within a bed vessel is enclosed in a pressure vessel and the air supplied to the fluidized bed is pressurized, for example in a compressor driven by a gas turbine.

The mass flow of pressurized air supplied to a PFBC plant is controlled within an interval of 40–105% of nominal flow. The pressurization is normally carried out in a gas turbine-driven compressor. From the point of view of capital cost, high compression ratios are desirable A gas turbine-driven compressor provides different possibilities of controlling the mass flow, depending on the type of gas turbine. A single-shaft unit may control the mass flow by varying the adjustment of compressor guide vanes and inlet valves, and, in addition, compressed air may be recirculated through the compressor. Moreover, in a multi-shaft unit, adjustable turbine guide vanes and nozzles as well as variable rotor speed are utilized.

The temperature of the air supplied from the compressor via the pressure vessel to the fluidized bed must be limited, both when the air is used for cooling of pressure vessel, bed vessel, cyclones and other supporting components arranged in the pressure vessel, and when temperature variations, caused by compression ratios and ambient temperature, in air supplied to the fluidized bed affect the output power from the plant and the efficiency of the plant.

The temperature of air supplied to the pressure vessel is not limited in normal PFBC plants, and thus there is no equalization of the temperature variations which occur in the pressurized air. Temperature variations occur as a consequence of variations in the ambient temperature and varying compression ratios and are compensated for in a normal PFBC plant by a change in the output power from the plant and in the efficiency of the plant.

The residual heat in flue gases emitted from a combustion plant is delivered to flue gas economizers, which are arranged in the flue gas paths.

SUMMARY OF THE INVENTION

The influence of variations in the ambient temperature, compression ratios in air pressurized in the compressor, and the like, which in a plant for combustion in a pressurized fluidized bed, a PFBC—plant, is reflected in the output power from the plant and in the efficiency of the plant, is essentially eliminated when temperature variations in incoming Combustion air are limited according to the present invention.

The plant comprises a combustor in the form of a pressurized fluidized bed, air paths in which air supplied to the fluidized bed is pressurized, flue gas paths in which energy contained in flue gases emitted from the plant is partially extracted with a gas turbine arranged in the flue gas paths, and a feedwater/steam system comprising heat transfer surfaces arranged in the air and flue gas paths.

According to the present invention, the temperature variations of pressurized air supplied to the fluidized bed are limited by means of heat transfer surfaces, preferably in the form of a heat exchanger, arranged in the air paths.

According to a preferred embodiment of the present invention, the temperature of flue gases discharged from the plant is simultaneously limited with heat transfer surfaces, arranged in the flue gas paths, in the form of cold and hot flue gas economizers. In addition, heat transfer surfaces arranged in the hot and cold sections of the flue gas paths and in the air paths are interconnted in the high temperature section of the feedwater/steam system of the combustion plant. By this interconnection and by the arrangement of control valves adjacent to the heat transfer surfaces, for control and distribution of the heat work in and between the heat transfer surfaces, the temperature of air supplied to the pressure vessel may be limited and maintained independent of temperature variations of air pressurized in the compressor while at the same time the flue gas temperature is limited.

The heat work in the heat transfer surfaces may be controlled from outside with temperature sensors, for example thermocouples, measuring temperatures of air and flue gas, respectively. Measured temperatures are compared, in conventional temperature regulators, with a desired value and the deviation gives a control signal out from the temperature regulator to the control valves arranged adjacent to the heat transfer surfaces. Based on the received control signal, the heat work in the heat-transfer surfaces is controlled.

Thus, according to the present invention, the necessary limitation of the temperature variations of air supplied to the fluidized bed is obtained, so that the output power from the combustion plant or the efficiency of the plant remains unaffected by ambient temperature and compression ratios while at the same time heat absorbed in the heat transfer surfaces is utilized in the feedwater/steam system of the plant In addition, during start-up and shutdown of a PFBC plant with control of air and flue gas temperatures according to the present invention, possibilities are provided of reducing the heating and cooling times.

The heating time during start-up can be reduced and hence the corrosion, caused by flue gas condensate in the gas paths, be reduced by the heat transfer surfaces upon start-up being traversed by steam from an external source, for example from an existing auxiliary boiler intended to supply the plant with de-aired water.

The cooling times can be reduced by the heat transfer surfaces, upon shutdown, being traversed by water, for example by being connected to a condenser circuit.

BRIEF DESCRIPTION OF THE DRAWINGS

The features and advantages of the present invention will be explained in greater detail with reference to functional and schematic flow diagrams, wherein.

DESCRIPTION OF THE PREFERRED EMBODIMENTS

Figure 1:
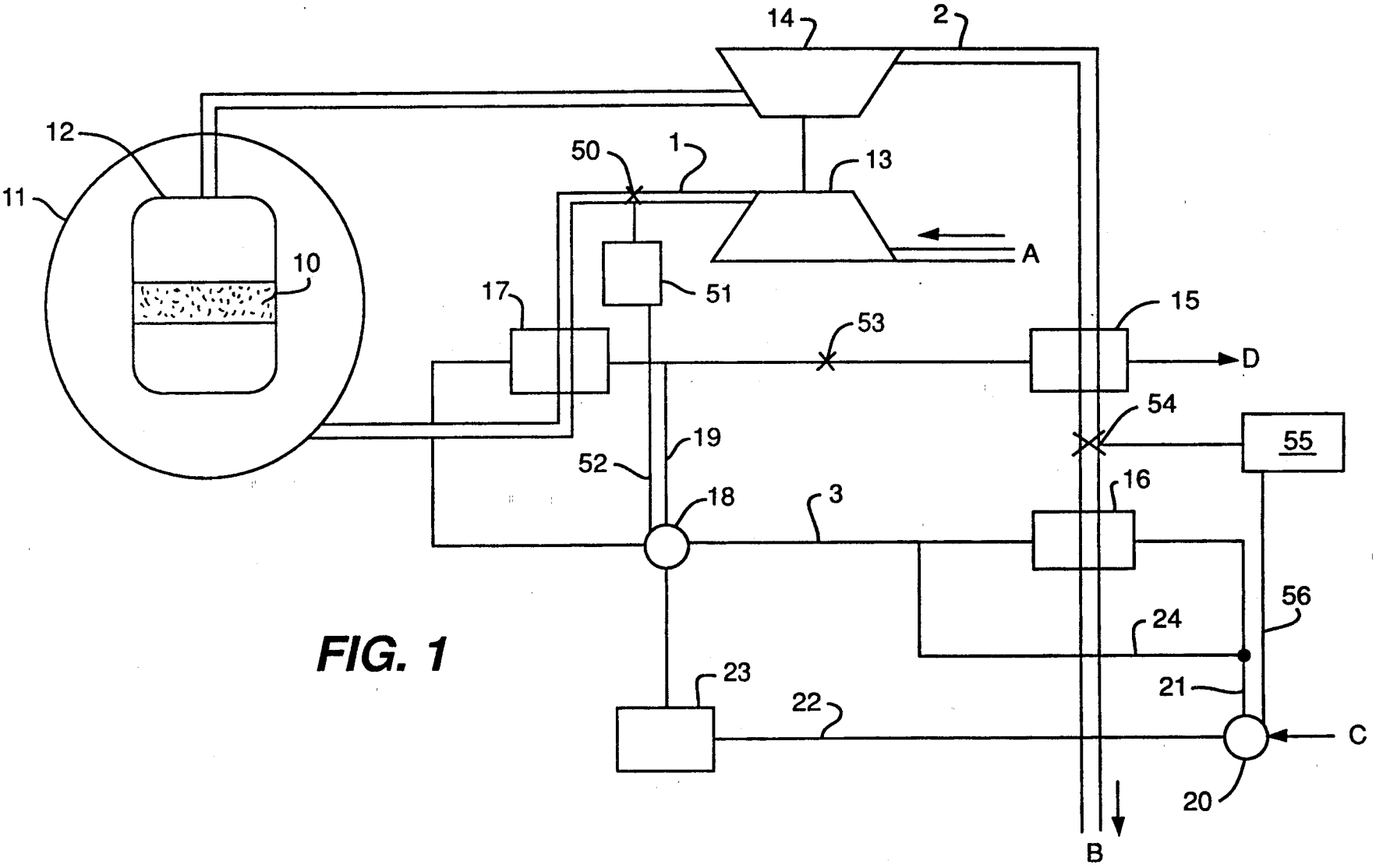
FIG. 1 illustrates a system for the limitation, in a combustion plant with gas turbine-driven pressurization of air supplied to the combustor, of temperature variations of pressurized air supplied to the fluidized bed in accordance with the present invention.

A system for limitation of temperature variations of pressurized air supplied to the fluidized bed according to the present invention is schematically illustrated in FIG. 1. The air is supplied to a combustor 10, in the form of a fluidized bed, through air paths 1, flue gases formed during the combustion are discharged through flue gas paths 2 and heat is extracted from the plant and utilized through a feedwater/steam system 3.

In a power plant with combustion in a pressurized fluidized bed, a Pressurized Fluidized Bed Combustion PFBC plant, the combustion takes place in a fluidized bed 10 contained within a bed vessel 12 enclosed in a pressure vessel 11. Air is introduced into the plant at A, is pressurized in a compressor 13, the temperature being raised to a temperature which depends on the prevailing compression ratio and the ambient temperature. The pressurized air is used for fluidization of the fluidized bed 10 and for combustion of fuel supplied to the fluidized bed 10.

The flue gases formed during the combustion pass through a gas turbine 14 arranged in the flue gas paths 2 of the plant, in which at least part of the energy contained in the flue gases is extracted. The compessor 13 is suitably driven by the gas turbine 14. In addition, to increase the efficiency of the plant, the residual heat is extracted from the flue gases in heat transfer surfaces 15, 16, arranged in both the hot and cold sections of the flue gas paths 2, for example flue gas economizers, designated as the hot flue gas economizer 15 and the cold flue gas economizer 16, respectively, before the flue gases are discharged from the plant at B.

In order not to subject the pressure vessel 11 or other components, arranged in the pressure vessel 11 or the bed vessel 12, to high temperatures, these are cooled by supplied pressurized air. To limit the temperature of the supplied pressurized air and to correct for temperature variations, caused by ambient temperature and compression ratios, the pressurized air passes through heat transfer surfaces 17, for example a heat exchanger, arranged in the air paths 1 beween the compressor 13 and the pressure vessel 11. The temperature variations, which are caused by fluctuating ambient temperature or compression ratios, are corrected according to the present invention in the heat exchanger 17, which means that the efficiency of the plant is not affected by these temperature fluctuations while at the same time energy extracted in the heat exchanger 17 is utilized in the feedwater/steam system 3 of the plant.

The temperature of the pressurized air is measured in conventional manner, for example by thermocouples 50, in the air paths downstream of the compressor 13. The measured temperature is compared with the desired temperature in a conventional temperature regulator 51. The deviation gives rise to an output signal, control signal supplied, to a control valve 18 by signal lines 52. The control valve 18 controls the heat work in the heat exchanger 17 by varying the flow of feedwater/steam through the heat exchanger 17, for example via the by-pass duct 19.

Variations in the feedwater/steam temperature arising downstream of the heat exchanger 17 are measured in conventional manner for example, by thermocouples 53 and corrected when the hot flue gases, in the hot flue gas economizer 15, pass through the feedwater/steam system 3 resulting in the flue gas temperature downstream of the hot flue gas economizer 15 being influenced.

The influence on the flue gas temperature downstream of the hot flue gas economizer 15 is measured in conventional manner for example, by the thermocouples 54 and, after treatment in a conventional temperature regulator 55, supplies a control signal to a control valve 20 by signal line 56. The control valve 20 then controls the heat work in the cold flue gas economizer 16, for example by distributing the feedwater/steam flow between the two branches 21 of the feedwater/steam circuit 3, comprising the cold flue gas economizer 16, and 22, comprising heat transfer surfaces 23 for heating another medium, for example high pressure feedwater. Where necessary or if the branch 22 is missing, feedwater/steam is conducted, at least partially, past the cold flue gas economizer 16, preferably via a by-pass duct 24.

By integration of the heat transfer surfaces 15, 16, 17, arranged in the air paths 1 and the flue gas paths 2, into the feedwater/steam system 3 of the power plant, the invention provides a limitation of the temperature of compressed air supplied to the pressure vessel and the bed vessel while at the same time temperature variations in this air are essentially eliminated. This means that the efficiency and power output of the plant remain essentially unaffected by variations in ambient temperature and compression ratios.

Energy extracted from air and flue gases is transferred to the feedwater/steam system 3 of the power plant. The heat transfer surfaces 15, 16, 17, which are necessary according to the present invention, are connected at the point C, for example to a feedwater tank, and at the point D, for example to a boiler arranged in the fluidized bed 10, to the high temperature section of the feedwater/steam system 3. In certain situations, for example during start-up and shutdown of the power plant, the heat transfer surfaces may be connected to a circuit by being interconnected at C and D. If the circuit is then provided with steam or cold water, heating and cooling, respectively, of air paths 1 and flue gas paths 2 may be obtained.

Figure 2:
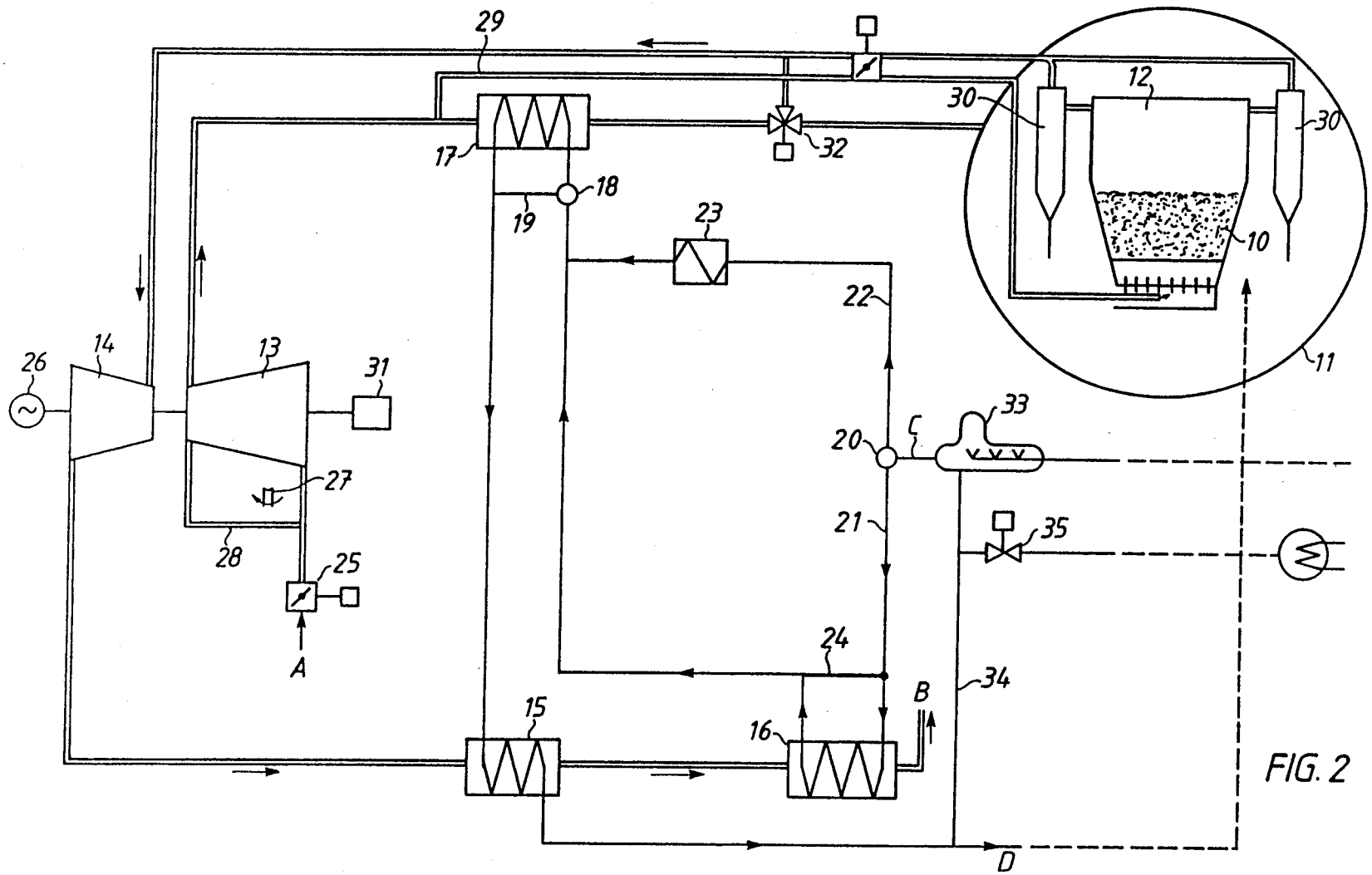
FIG. 2 shows schematically the parts of the air and flue gas paths, the feedwater/steam system and other components of the plant, which are necessary for the present invention.

FIG. 2 schematically shows how the heat transfer surfaces, which are necessary for the present invention, are arranged in the air paths 1, flue gas paths 2 and feedwater/steam system 3 of the power plant.

In a PFBC plant pressurized air is supplied to a fluidized bed 10 enclosed in a pressure vessel 11. The air is supplied to the fluidized bed 10 for fluidization of the bed material and for combustion of fuel supplied to the fluidized bed 10. The air, which is admitted from the environment via at least one controllable throttle valve 25, is pressurized in a compressor 13, suitably driven by a gas turbine 14 arranged in the flue gas paths. The gas turbine 14 also drives a generator 26. The gas turbine 14 and the compressor 13 are often integrated into one unit and may be of an arbitrary type with a variable number of shafts. The figures show no intermediate cooling of the pressurized air, which occurs in multi-shaft units.

The mass flow of pressurized air to the pressure vessel 11 in a PFBC plant is controlled within an interval of 40–105% of nominal flow. The mass flow from the compressor 13 may, depending on the type of gas turbine/compressor unit 14/13, be controlled in different ways A single-shaft gas turbine/compressor unit 14/13, as indicated in FIG. 2, may be controlled by adjusting the throttle valve 25, the compressor guide vanes 27 and via a recirculation circuit 28 for pressurized air. For a multi-shaft gas turbine/compressor unit, the possibilities of varying turbine guide vanes, turbine nozzles and rotor speed are added.

The temperature of the pressurized air usually amounts to 350–450° C., depending on compression ratio and ambient temperature. Before the pressurized air is supplied to the pressure vessel 11, it is cooled to a temperature suitable for the pressure vessel 11 and the parts enclosed in the pressure vessel 11, usually 200–300° C., in at least one heat exchanger 17 arranged in the air paths. According to the invention, the heat exchanger 17 is arranged in the high temperature section of the feedwater/steam system 3, up-stream of a flue gas economizer 15 arranged in the hot part of the flue gas paths 2.

To maintain the temperature of pressurized air supplied to the pressure vessel 11 essentially independent of compression ratio and ambient temperature, the feedwater/steam flow through the heat exchanger 17 is controlled in a control valve 18. The control valve 18 distributes the feedwater/steam flow, between the heat exchanger 17 and a by-pass duct 19, based on the deviation between desired and measured temperature of the pressurized air. With the by-pass duct 19, the feedwater/steam flow is adapted to the measured temperature of the pressurized air. Without the by-pass duct 19, there would be a risk of the feedwater temperature and hence the temperature of air supplied to the pressure vessel 11 dropping towards the ambient temperature.

The control in the heat exchanger 17 gives rise to variations of the feedwater/steam temperature downstream of the heat exchanger 17, which are essentially eliminated in at least one flue gas economizer 15 arranged in the hot section of the flue gas paths 2, resulting in the flue gas temperature downstream of the hot flue gas economizer 15 being affected. The influence on the flue gas temperature is essentially eliminated in at least one flue gas economizer 16 arranged in the cold section of the flue gas paths 2 by adapting the feedwater/steam flow therethrough to correct, in conventional manner, any deviation, measured in the flue gas paths 2 downstream of the hot flue gas economizer 15, of the flue gas temperature relative to the desired flue gas temperature.

The control of the feedwater/steam flow through the cold flue gas economizer is performed with the control valve 20 which controls the distribution between the two parallel branches 21 and 22 in the feedwater/steam system 3, including the cold flue gas economizer 16 and the heat exchanger 23, respectively, connected for heating of another medium, for example high-pressure feedwater.

With heat transfer surfaces comprising at least one heat exchanger 17 arranged in the air paths, in which the temperature of air supplied to the pressure vessel 11 and the fluidized bed 10 is limited and temperature variations in the air are essentially eliminated, at least one flue gas economizer 15 arranged in the hot section of the flue gas paths, in which simultaneously with the flue gas temperature being reduced temperature variations of the feedwater/steam are essentially eliminated by allowing the flue gas temperature downstream of the hot flue gas economizer 15 to vary, at least one flue gas economizer 16 arranged in the cold section of the flue gas paths, in which variations of the flue gas temperature are essentially eliminated, and the by-pass ducts 19 and 24 for control of the heat work in the heat exchanger 17 and the cold flue gas economizer 16, respectively, according to the present invention a limitation of the temperature of air supplied to the pressure vessel 11 and of flue gases emitted from the PFBC plant is obtained while at the same time the influence from ambient temperature and compression ratios on the efficiency or the power output of the plant is essentially eliminated.

The heat exchanger 17 can be dimensioned for two cases:

I. Maximum heat work for the operation at the maximum air temperature and full air flow;

II. Only part of the heat work of the operation, which means that part of the pressurized air is conducted past the heat exchanger 17 in a pipe 29 direct to the air inlet to the fluidized bed 10.

Figure 3:
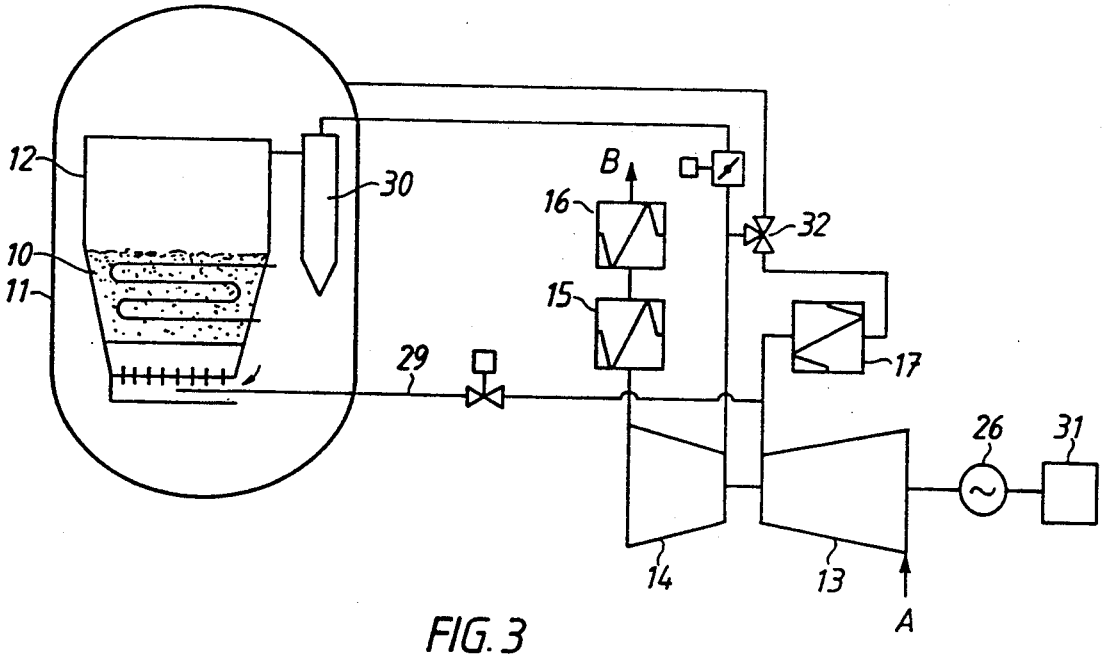
FIG. 3 illustrates alternative solutions to the supply of the pressurized air to the pressure vessel.

The two cases are illustrated in FIG. 3.

Case I corresponds well with the previous description whereas in case II only part of the air quantity from the compressor 13 passes through the heat exchanger 17. The remaining air quantity is supplied, via a pipe 29, to the cooled air flow near the air inlet to the fluidized bed 10. The distribution of air is controlled such that the heat work in the heat exchanger 17 is maintained constant, that is, an increased ambient temperature entails an increased flow via the pipe 29. Case II means that the temperature of vital components such as pressure vessel 11, bed vessel 12 and cyclones 30 may be limited with a heat exchanger 17 of limited power.

Figure 4:
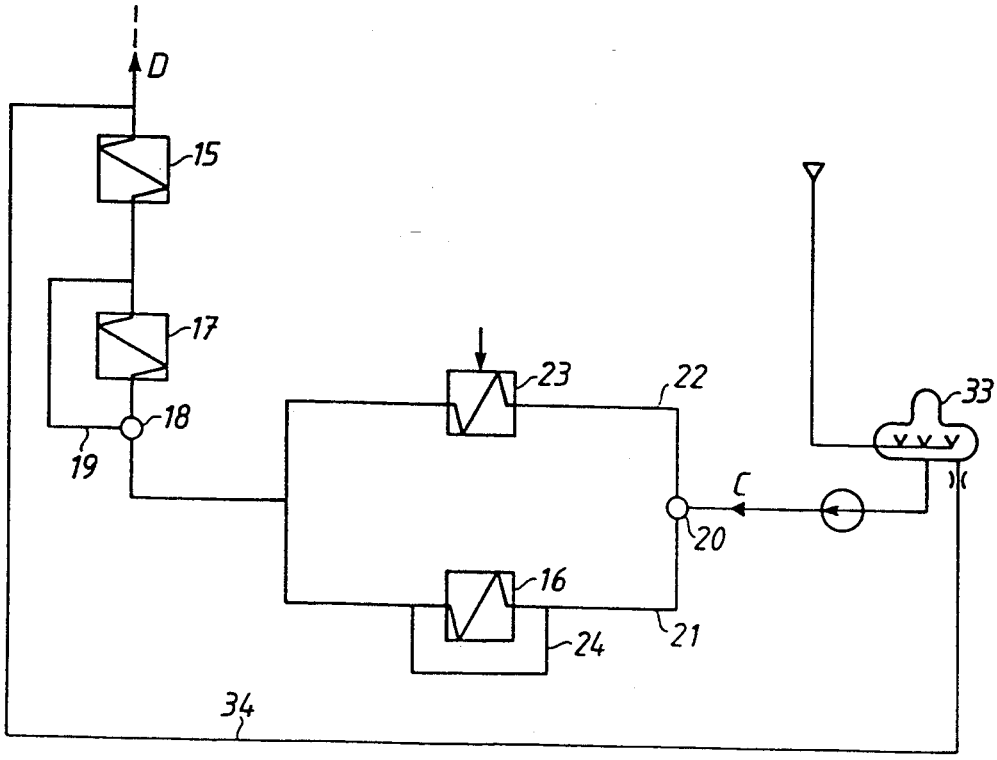
FIGS. 4 and 5 show respectively, design and connection of the feedwater/steam system to an auxiliary boiler during start-up and to a condenser circuit during cooling.

During start-up of a PFBC plant, air paths 1 and flue gas paths 2 are preheated according to FIG. 4. Preheating is usually performed by burning fossil fuels in the air paths 1 upstream of the fluidized bed 10. To avoid corrosion connected with flue gas condensate, components included in the air paths 1 and the flue gas paths 2 must be preheated, for example with dry hot air, to a temperature exceeding the dew point of the flue gases which occur during the preheating. This first phase of the preheating is achieved in a favorable way by connecting the heat transfer surfaces,—the heat exchanger 17, the hot flue gas economizer 15 and the cold flue gas economizer 16,—, which according to the invention are interconnected and arranged in the air paths 1 and the flue gas paths 2, to an external source (not shown) with hot medium, for example a boiler present in the plant and intended to supply the plant with de-aired water during the start-up stage.

During the starting period the gas turbine 14 is driven by a starting device 31, which may consist of a frequency convertor which permits the gas turbine 14 to be run as a synchronous motor, but may also consist of a motor connected to any of the shafts of the gas turbine 14, or other starting equipment for gas turbines The air is heated in the heat exchanger 17, the hot flue gas economizer 15 and the cold flue gas economizer 16 and transfers the heat to walls and other components in the air paths 1 and the flue gas paths 2. If the bed vessel 12 is empty and the valve 32 shown in FIGS. 2 and 3 is open, the air will flow through the pressure vessel 11 and the bed vessel 12 thus heating these.

The heat exchanger 17, the hot flue gas economizer 15 and the cold flue gas economizer 16 are connected in a starting circuit, which is illustrated in FIG. 4. As before, the heat transfer surfaces 15, 16, 17 are connected to the high temperature section of the feedwater/steam system 3 of the plant, for example at an existing feedwater tank 33. The feedwater tank 33 is provided with steam, for example from an auxiliary boiler (not shown) present in the plant. The feedwater/steam circulates during the starting stage from the feedwater tank 33 through the two flue gas economizers 15 and 16 and the heat exchanger 17 and back to the feedwater tank 33 via the open return pipe 34.

Figure 5:
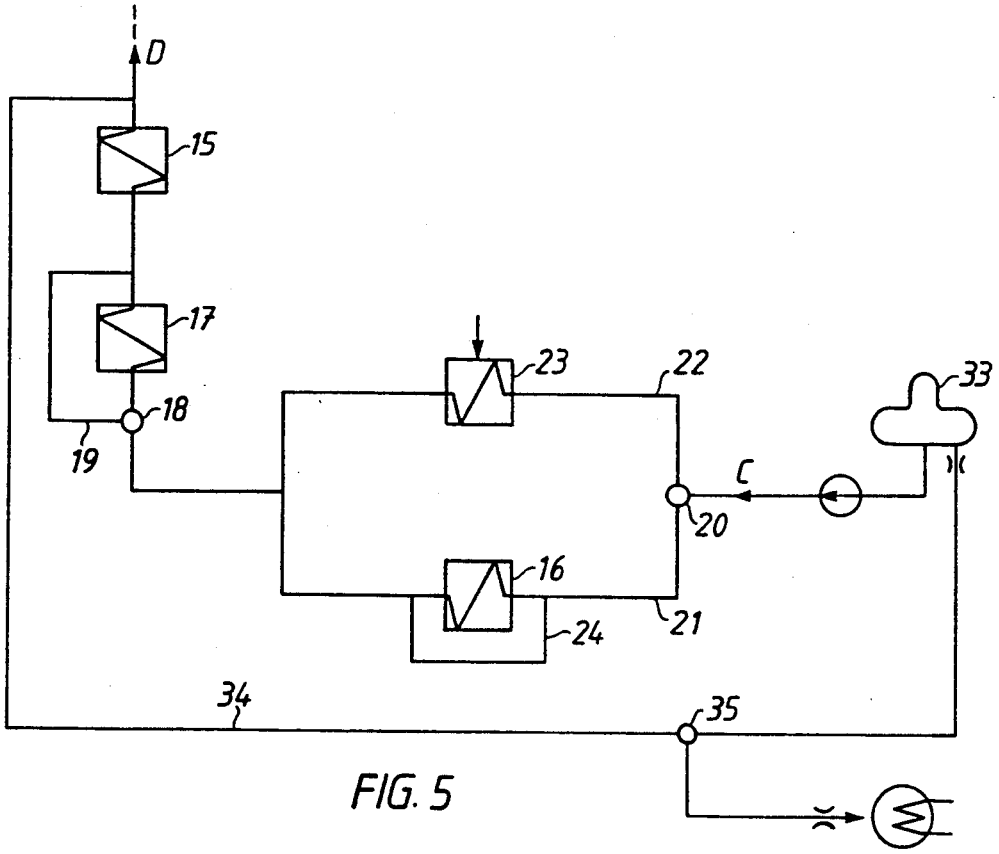

During shutdown of the plant, the cooling period can be shortened by utilizing the heat transfer surfaces 15, 16 and 17 arranged in the air paths 1 and the flue gas paths 2 according to the invention. This makes the plant more rapidly available for, for example, maintenance work. The heat transfer surfaces 15, 16 and 17 are connected (see FIG. 5) to an external source with a coolant, for example a condenser circuit located in the plant for hot water production, via a valve 35. This causes the heat transfer surfaces 15, 16 and 17 arranged in the air paths 1 and the flue gas paths 2 to be traversed by a cold medium and the temperature in air and flue gas paths to be rapidly reduced.

Figure 6:
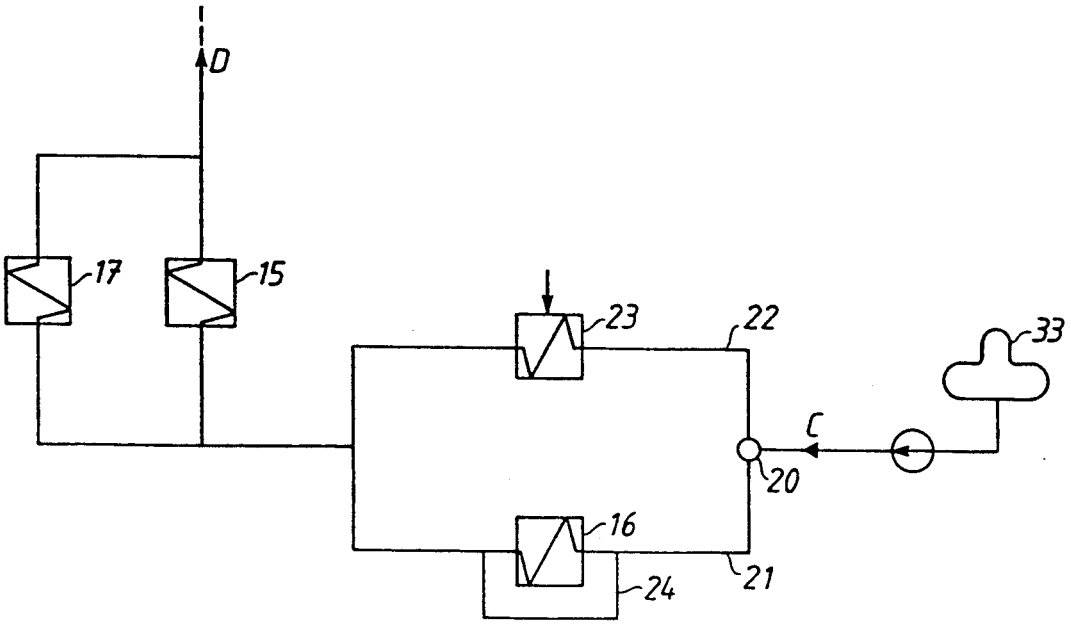
FIG. 6 shows an alternative connection which under special circumstances, especially when only part of the pressurized air passes the heat transfer surfaces in the air paths, provides increased efficiency.

An alternative solution of the arrangement of the heat exchanger 17 in the system, in relation to the hot flue gas economizer 15, is shown in FIG. 6. The heat exchanger 17 is connected in parallel with the hot flue gas economizer 15, which reduces the temperature difference between air and feedwater/steam in the heat exchanger 17. Especially when dimensioning the heat exchanger 17 in accordance with the above case II, this solution may further increase the efficiency of the plant.

We claim:

1. A method for cooling and eliminating temperature variations in a power plant for combustion of a fuel in a pressurized fluidized bed, said method comprising the steps of:

pressuring air in a compressor;

supplying the pressurized air to the pressurized fluidized bed through air paths;

cooling the pressurized air and substantially eliminating temperature variations in the pressurized air prior to supplying the pressurized air into the pressurized fluidized bed in at least one heat transfer surface provided in the air paths;

connecting said at least one heat transfer surface with a high temperature section of a feedwater/steam section for utilizing energy extracted in said heat transfer surface;

eliminating the temperature variations of the pressurized air supplied to the pressurized fluidized bed by controlling the feedwater/steam flow through said heat transfer surface based on the deviations between a desired temperature of the air to be delivered to the fluidized bed and a measured temperature of the pressurized air from the compressor.

2. A method of cooling and eliminating temperature according to claim 1, wherein said at least one heat transfer surface is a heat exchanger.

3. A method of cooling and eliminating temperature variations according to claim 2, wherein said cooling and eliminating temperature variations includes measuring the temperature of the pressurized air from said compressor with temperature sensing means, comparing said measured temperature with said desired temperature in temperature regulating means, and based on a resulting temperature deviation supplying a control signal to a control valve means for controlling said flow of the feedwater/steam through said heat exchanger.

4. A method of cooling and eliminating temperature variations according to claim 2 further including the steps of:

connecting at least one heat transfer surface provided in flue gas paths to the high temperature section of the feedwater/steam system;

cooling and eliminating temperature variations in flue gases by said heat transfer surfaces in said flue gas paths by controlling and distributing the heat work between said heat transfer surfaces arranged in said air and flue gas paths.

5. A method of cooling and eliminating temperature variations according to claim 4, wherein said controlling and distributing is based on temperature deviations measured in said flue gas paths.

6. A method of cooling and eliminating temperature variations according to claim 4, wherein said heat transfer surfaces include at least one hot flue gas economizer and at least one cold flue gas economizer and wherein variations in the feedwater/steam temperature downstream of said heat exchanger are substantially eliminated in said hot flue gas economizer connected to the hot section of the flue gas paths, and wherein variations in flue gas temperature are substantially eliminated in said cold flue gas economizer arranged in the cold section of the flue gas paths by controlling the feedwater/steam flow through the cold flue gas economizer based on temperature deviations measured in said flue gas path downstream of said hot flue gas economizer.

7. A method of cooling and eliminating temperature variations according to claim 2, wherein at least part of the pressurized air supplied to the pressurized fluidized bed by-passes said heat exchanger.

8. A method of cooling and eliminating temperature variations according to claim 6, wherein at least part of the pressurized air supplied to the pressurized fluidized bed by-passes said heat exchanger.

9. In a power plant for combustion of a fuel in a pressurized fluidized bed, enclosed in a pressure vessel, apparatus for controlling temperature within said bed comprising:

air paths and a compressor arranged in the air for pressurizing air supplied to the fluidized bed;

flue gas paths and a gas turbine arranged in the flue gas paths for partially extracting energy contained in the flue gases;

a feedwater/steam system interconnecting between said air and flue gas paths;

means for limiting temperature of the compressed air to a desired temperature and for substantially eliminating variations in the compressed air temperature said means including:

a) at least one heat transfer surface arranged in said air paths, between said compressor and said pressure vessel, said heat transfer surface also being connected to a high temperature section of the feedwater/steam system;

b) means for controlling a flow of feedwater/steam through said heat transfer surface based on temperature deviations between said desired temperature and a measured temperature of the pressurized air from the compressor;

c) means for measuring the temperature of the pressurized air from the compressor; and d) means for comparing said measured temperature with said desired temperature and based on the resulting deviations supplying a control signal to said controlling means.

10. An apparatus according to claim 9, wherein said at least one heat transfer surface is a heat exchanger.

11. An apparatus according to claim 10, further comprising:

means for cooling and substantially eliminating temperature variations in said flue gas paths including at least one heat transfer surface arranged in said flue gas paths and connected to said high temperature section of the feedwater/steam system.

12. An apparatus according to claim 10, wherein heat transfer surfaces are arranged in said flue gas paths to include at least one hot flue gas economizer and at least one cold flue gas economizer and wherein variations in the feedwater/steam temperature downstream of said heat exchanger are substantially eliminated in said hot flue gas economizer connected in the hot section of the flue gas paths.

13. An apparatus according to claim 12 further comprising means for controlling the feedwater/steam flow through the cold flue gas economizer based on temperature deviations measured in said flue gas path downstream of said hot flue gas economizer to substantially eliminate variations in flue gas temperature.

14. An apparatus according to claim 10, wherein at least part of the pressurized air supplied to the pressurized fluidized bed by-passes said heat exchanger.

* * * * *